US011248281B2

(12) United States Patent
Seki et al.

(10) Patent No.: US 11,248,281 B2
(45) Date of Patent: Feb. 15, 2022

(54) ALUMINUM MEMBER AND METHOD FOR PRODUCING SAME

(71) Applicant: NIPPON LIGHT METAL COMPANY, LTD., Tokyo (JP)

(72) Inventors: Yusuke Seki, Shizuoka (JP); Yoshihiro Taguchi, Shizuoka (JP)

(73) Assignee: NIPPON LIGHT METAL COMPANY, LTD., Tokyo (JP)

( * ) Notice: Subject to any disclaimer, the term of this patent is extended or adjusted under 35 U.S.C. 154(b) by 0 days.

(21) Appl. No.: 16/642,145

(22) PCT Filed: Aug. 2, 2018

(86) PCT No.: PCT/JP2018/029077
§ 371 (c)(1),
(2) Date: Feb. 26, 2020

(87) PCT Pub. No.: WO2019/044368
PCT Pub. Date: Mar. 7, 2019

(65) Prior Publication Data

US 2020/0299811 A1 Sep. 24, 2020

(30) Foreign Application Priority Data

Aug. 29, 2017 (JP) ..... JP2017-164174

(51) Int. Cl.
*C25D 11/04* (2006.01)
*C25D 11/16* (2006.01)
(Continued)

(52) U.S. Cl.
CPC ..... *C22C 21/08* (2013.01); *B24C 1/08* (2013.01); *C25D 11/08* (2013.01); *C25D 11/10* (2013.01)

(58) Field of Classification Search
None
See application file for complete search history.

(56) References Cited

U.S. PATENT DOCUMENTS 5,064,511 A * 11/1991 Gobbetti ..... B41N 3/034 205/201
2002/0011168 A1 1/2002 Miwa et al.
(Continued)

FOREIGN PATENT DOCUMENTS

CN 1192906 C 3/2005
CN 101498021 A 8/2009
(Continued)

OTHER PUBLICATIONS

English Translation of JP2004091851, EPO Oct. 2020, 7 pages (Year: 2020).*
(Continued)

*Primary Examiner* — Adam Krupicka
(74) *Attorney, Agent, or Firm* — Metrolex IP Law Group, PLLC

(57) ABSTRACT

An aluminum member includes: a substrate formed of aluminum or an aluminum alloy that contains 0 to 10% by mass of magnesium, 0.1% by mass or less of iron, and 0.1% by mass or less of silicon and a balance of which is aluminum and unavoidable impurities; and an anodic oxide coating formed on a surface of the substrate. A surface of the substrate on the anodic oxide coating side has an arithmetical mean height Sa of 0.1 to 0.5 μm, a maximum height Sz of 0.2 to 5 μm, and an mean width of roughness profile elements Rsm of 0.5 to 10 μm, where the arithmetical mean height Sa, the maximum height Sz, and the mean width of roughness profile elements Rsm are measured after the anodic oxide coating is removed.

8 Claims, 2 Drawing Sheets

(51) Int. Cl.

| | |
|---|---|
| ***C25D 11/18*** | (2006.01) |
| ***C22C 21/08*** | (2006.01) |
| ***B24C 1/08*** | (2006.01) |
| ***C25D 11/08*** | (2006.01) |
| ***C25D 11/10*** | (2006.01) |

(56) References Cited

U.S. PATENT DOCUMENTS

| | | | | |
|---|---|---|---|---|
| 2008/0085421 | A1 | 4/2008 | Oguri | |
| 2010/0243458 | A1 | 9/2010 | Kojima et al. | |
| 2014/0193607 | A1* | 7/2014 | Browning ..... | C25D 11/12 428/138 |
| 2015/0060289 | A1 | 3/2015 | Saiki et al. | |

FOREIGN PATENT DOCUMENTS

| | | | |
|---|---|---|---|
| CN | 101835925 | A | 9/2010 |
| CN | 104024489 | A | 9/2014 |
| EP | 1862569 | A1 | 12/2007 |
| JP | S48-068435 | A | 9/1973 |
| JP | S54-046136 | A | 4/1979 |
| JP | 2004-091844 | A | 3/2004 |
| JP | 2004-091851 | A | 3/2004 |
| JP | 2006-103030 | A | 4/2006 |

OTHER PUBLICATIONS

Office action dated Sep. 23, 2020 in a counterpart Chinese patent application.
Office action dated May 5, 2020 in a counterpart Korean patent application.
Office Action dated Jun. 24, 2020 in a counterpart Chinese patent application.

* cited by examiner

ALUMINUM MEMBER AND METHOD FOR PRODUCING SAME

TECHNICAL FIELD

The present invention relates to aluminum members and methods for producing the same. In particular, the present invention relates to an aluminum member having an appearance as white as paper and a method for producing the same.

BACKGROUND ART

In recent years, there have been an increasing number of demands for casings having an appearance as white as paper, for example, for portable devices and personal computers. To meet such demands, attempts have been made to make the appearance of aluminum white by forming an anodic oxide coating containing an aluminum oxide on the surface of the aluminum.

For example, Patent Literature 1 discloses a technique in which abrasive blasting is performed on the surface of an aluminum alloy to form a grained surface having irregularities, and after the abrasive blasting, a chemical treatment is performed such as etching or a chemical polishing process for chemically polishing the surface of the aluminum alloy. Patent Literature 1 explains that the chemical treatment makes the irregularities of the grained surface coarse, improving the whiteness of the aluminum alloy.

CITATION LIST

Patent Literature

Patent Literature 1: Japanese Patent Application Publication No. 2004-91851

SUMMARY OF INVENTION

The particle diameter of particles used for abrasive blasting is typically several hundred micro meters, and even for smaller ones, it is 50 μm as described in Patent Literature 1. Unfortunately, in the case of using particles having such diameters, the surface of an aluminum alloy may have many deep wedge-shaped pits after abrasive blasting. Light transmitted through the anodic oxide coating may be caught by these pits, and this may decrease the whiteness of the aluminum member. In the case where the surface shape of an aluminum alloy is not appropriate, even if the L* value in the L*a*b* color system is high, light does not diffuse sufficiently on the surface of the aluminum alloy. As a result, the whiteness of the aluminum member is low when the surface is viewed obliquely, and thus the appearance may not be as white as paper.

The present invention has been made in light of such problems that conventional techniques have. Hence, an object of the present invention is to provide an aluminum member having an appearance as white as paper and a method for producing the same.

An aluminum member according to an aspect of the present invention includes a substrate formed of aluminum or an aluminum alloy and an anodic oxide coating formed on the surface of the substrate. The aluminum or the aluminum alloy contains 0 to 10% by mass of magnesium, 0.1% by mass or less of iron, and 0.1% by mass or less of silicon, and the balance is aluminum and unavoidable impurities. The surface of the substrate on the anodic oxide coating side has an arithmetical mean height Sa of 0.1 to 0.5 μm, a maximum height Sz of 0.2 to 5 μm, and an mean width of roughness profile elements Rsm of 0.5 to 10 μm, where the arithmetical mean height Sa, the maximum height Sz, and the mean width of roughness profile elements Rsm are measured after the anodic oxide coating is removed.

DESCRIPTION OF EMBODIMENTS

Figure 1:
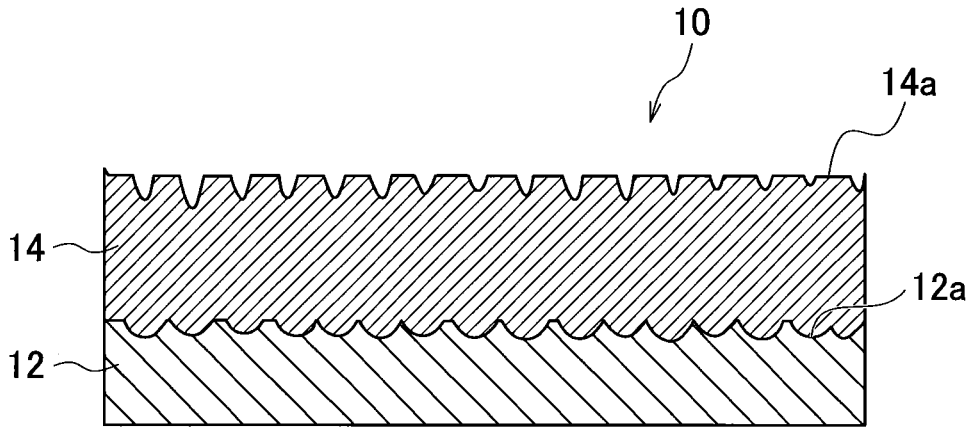
FIG. 1 is a cross-sectional diagram illustrating an example of an aluminum member according to the present embodiment.

Hereinafter, an aluminum member and a method for producing the aluminum member according to the present embodiment will be described in detail using the drawings. Note that the dimensional ratios in the drawings are exaggerated for convenience of explanation and they may be different from the actual ones.

[Aluminum Member]

As illustrated in FIG. 1, an aluminum member 10 of the present embodiment includes a substrate 12 and an anodic oxide coating 14. These constituents will be described in the following.

(Substrate 12)

The substrate 12 is formed of aluminum or an aluminum alloy that contains 0 to 10% by mass of magnesium, 0.1% by mass or less of iron, 0.1% by mass or less of silicon, and the balance of which is aluminum and unavoidable impurities. In the present embodiment, the magnesium content in the aluminum or aluminum alloy is 0 to 10% by mass. In the present embodiment, magnesium does not necessarily need to be contained in the substrate 12, but magnesium contained in the substrate 12 allows aluminum and magnesium to form a solid solution, improving the strength of the substrate 12. The magnesium content of 10% by mass or less reduces the degradation in the corrosion resistance of the substrate 12 while improving the strength of the substrate 12. Note that the magnesium content is preferably 0.5% by mass or more, and is more preferably 1% by mass or more. In addition, the magnesium content is preferably 8% by mass or less, and more preferably 5% by mass or less.

The iron content of the substrate 12 is 0.1% by mass or less. The silicon content of the substrate 12 is 0.1% by mass or less. Each of iron and silicon is unlikely to form a solid solution with aluminum. Hence, in the case where these elements are contained in the substrate 12, when the substrate 12 is anodized, these elements are likely to precipitate in the anodic oxide coating 14 as a second phase containing iron or silicon. If the anodic oxide coating 14 contains a second phase as above, the second phase absorbs part of light transmitted through the anodic oxide coating 14, and this may make the aluminum member 10 look, for example, a yellowish color. Hence, the substrate 12 in the present embodiment contains 0.1% by mass or less of iron. Similarly, the substrate 12 in the present embodiment contains 0.1% by mass or less of silicon. Note that the substrate 12 preferably contains 0.05% by mass or less of iron. The substrate 12 also preferably contains 0.05% by mass or less of silicon.

The substrate 12 may contain unavoidable impurities. Unavoidable impurities in the present embodiment mean substances present in the raw materials or substances inevitably mixed in the production processes. Although unavoidable impurities are originally unnecessary, they are accepted because the amount is very small and they do not affect the properties of the aluminum or aluminum alloy. Examples of unavoidable impurities that may be contained in the aluminum or aluminum alloy are elements other than aluminum (Al), magnesium (Mg), iron (Fe), and silicon (Si). Examples of unavoidable impurities that may be contained in the aluminum or aluminum alloy include copper (Cu), manganese (Mn), chromium (Cr), zinc (Zn), titanium (Ti), gallium (Ga), boron (B), vanadium (V), zirconium (Zr), lead (Pb), calcium (Ca), and cobalt (Co). The amount of unavoidable impurities is preferably 0.5% by mass or less in total in the aluminum or aluminum alloy, more preferably 0.2% by mass or less, further preferably 0.15% by mass or less, and particularly preferably 0.10% by mass or less. The content of each element contained as unavoidable impurities is preferably 0.05% by mass or less, and more preferably 0.03% by mass or less.

Note that the shape and thickness of the substrate 12 are not limited to specific ones but may be changed as necessary depending on the purposes. The substrate 12 may be processed or subjected to or heat treatment.

(Anodic Oxide Coating 14)

The anodic oxide coating 14 is formed on a surface 12*a* of the substrate 12. This anodic oxide coating 14 improves the corrosion resistance, wear resistance, and other characteristics. The anodic oxide coating 14 typically includes a barrier layer disposed on the substrate 12 side and a porous layer disposed on the opposite side of the barrier layer from the substrate 12 and including coating cells each having a micropore at its center. The hole diameter of the micropores is not limited to specific ones but typically around 10 to 100 nm.

The metal elements and semimetal elements contained in the anodic oxide coating 14 preferably include 0% by mass or more of magnesium, 0.1% by mass or less of iron, 0.1% by mass or less of silicon, and that the balance is aluminum and unavoidable impurities, where the total of metal elements and semimetal elements is taken as 100% by mass. The main component of the anodic oxide coating 14 is aluminum oxide, and aluminum oxide itself is colorless and transparent. However, iron, silicon, and the like are unlikely to form a solid solution with aluminum and likely to precipitate in the anodic oxide coating 14 as a second phase. In the case where the anodic oxide coating 14 contains such as second phase, part of the light transmitted through the anodic oxide coating 14 is absorbed by the second phase, and accordingly, the aluminum member 10 looks, for example, a yellowish color in some cases. Hence, in the present embodiment, the iron content of the anodic oxide coating 14, in which the total of metal elements and semimetal elements contained in the anodic oxide coating 14 is taken as 100% by mass, is preferably 0.1% by mass or less. Also, the silicon content of the anodic oxide coating 14, in which the total of metal elements and semimetal elements contained in the anodic oxide coating 14 is taken as 100% by mass, is preferably 0.1% by mass or less. The iron content and silicon content of the anodic oxide coating 14 lower than the specified values as above reduce light absorption in the anodic oxide coating 14 and increase the whiteness of the aluminum member 10. Note that the anodic oxide coating 14 may contain 90% by mass or more of aluminum oxide.

The magnesium content of the anodic oxide coating 14 is preferably 0% by mass or more. This means that the anodic oxide coating 14 does not necessarily need to contain magnesium. However, magnesium easily forms a solid solution with aluminum and is unlikely to precipitate in the anodic oxide coating 14 as a second phase. Hence, magnesium contained in the anodic oxide coating 14 is also unlikely to affect the whiteness of the aluminum member 10. Note that it is conceivable that magnesium contained in the anodic oxide coating 14 is a remaining of magnesium that had been contained the substrate 12, left after anodization of the anodic oxide coating 14. Hence, the magnesium content of the anodic oxide coating 14 is not limited to specific values, but it is preferably 10% by mass or less, as in the case of the magnesium content of the substrate 12. Note that the magnesium content is preferably 0.5% by mass or more and further preferably 1% by mass or more. Also, the magnesium content is more preferably 8% by mass or less and further preferably 5% by mass or less.

The anodic oxide coating 14 may contain unavoidable impurities. Unavoidable impurities that may be contained in the anodic oxide coating 14 are elements other than aluminum (Al), magnesium (Mg), iron (Fe), and silicon (Si). Examples of unavoidable impurities that may be contained in the anodic oxide coating 14 include copper (Cu), manganese (Mn), chromium (Cr), zinc (Zn), titanium (Ti), gallium (Ga), boron (B), vanadium (V), zirconium (Zr), lead (Pb), calcium (Ca), and cobalt (Co). The amount of unavoidable impurities in total in the anodic oxide coating 14 is preferably 0.5% by mass or less, more preferably 0.2% by mass or less, further preferably 0.15% by mass or less, and particularly preferably 0.10% by mass or less. The content of each element contained as unavoidable impurities is preferably 0.05% by mass or less and more preferably 0.03% by mass or less.

The magnesium content, iron content, and silicon content described above are contents on the basis that the total of metal elements and semimetal elements contained in the anodic oxide coating 14 is taken as 100% by mass. Note that in the present embodiment, metal elements include alkali metals, alkaline earth metals, and transition metals. Semimetal elements include boron, silicon, germanium, arsenic, antimony, and tellurium. Hence, nonmetal elements such as oxygen which is derived from aluminum oxide are not included in metal elements and semimetal elements.

The thickness of the anodic oxide coating 14 is not limited to specific values, but is preferably 1 to 50 μm. The anodic oxide coating 14 having a thickness of 1 μm or more prevents the substrate 12 from corroding. In addition, the anodic oxide coating 14 having a thickness of 50 μm or less reduces the light absorption of the anodic oxide coating 14, and this improves the lightness of the aluminum member 10. Note that the thickness of the anodic oxide coating 14 is preferably 5 to 20 μm.

The surface 12*a* of the substrate 12 on the anodic oxide coating 14 side has an arithmetical mean height Sa of 0.1 to 0.5 μm, a maximum height Sz of 0.2 to 5 μm, and an mean width of roughness profile elements Rsm of 0.5 to 10 μm, where these values are measured after the anodic oxide coating 14 is removed.

The arithmetical mean height Sa of 0.1 μm or more makes light transmitted through the anodic oxide coating 14 be diffusely reflected on the surface 12*a* of the substrate 12, and this enables the appearance of the aluminum member 10 to look white even if it is viewed obliquely from different viewing angles. The arithmetical mean height Sa of 0.5 μm or less prevents light transmitted through the anodic oxide coating 14 from being caught between irregularities on the surface 12*a* of the substrate 12, and this prevents the appearance of the aluminum member 10 from looking gray. Note that the arithmetical mean height Sa is preferably 0.1 to 0.4 μm.

The maximum height Sz of 0.2 μm or more makes light transmitted through the anodic oxide coating 14 be diffusely reflected on the surface 12*a* of the substrate 12, and this enables the appearance of the aluminum member 10 to look white even if it is viewed obliquely from different viewing angles. The maximum height Sz of 5 μm or less prevents light transmitted through the anodic oxide coating 14 from being caught between irregularities on the surface 12*a* of the substrate 12, and this prevents the appearance of the aluminum member 10 from looking gray. Note that the maximum height Sz is preferably 1 to 4.7 μm.

The mean width of roughness profile elements Rsm of 0.5 μm or more prevents light transmitted through the anodic oxide coating 14 from being caught between irregularities on the surface 12*a* of the substrate 12 because the cycles of irregularities on the surface 12*a* of the substrate 12 are not too small. This prevents the appearance of the aluminum member 10 from looking gray. In the case where the mean width of roughness profile elements Rsm is 10 μm or less, the cycles of irregularities of the surface 12*a* of the substrate 12 are not too large. As a result, light transmitted through the anodic oxide coating 14 is diffusely reflected on the surface 12*a* of the substrate 12, and the appearance of the aluminum member 10 looks white even if it is viewed obliquely from different viewing angles. Note that the mean width of roughness profile elements Rsm is preferably 5 to 9.5 μm.

The arithmetical mean height Sa, the maximum height Sz, and the mean width of roughness profile elements Rsm on the surface 12*a* of the substrate 12 can be measured by removing the anodic oxide coating 14 from the substrate 12. Note that because the irregularities on the surface 12*a* of the substrate 12 become smoother by anodization, the irregularities on the surface 12*a* of the substrate 12 before anodization and the irregularities on the surface 12*a* of the substrate 12 after anodization may be different in shape. Hence, in the present embodiment, the shape of the surface 12*a* of the substrate 12 is measured after the anodic oxide coating 14 is removed. The method of removing the anodic oxide coating 14 from the substrate 12 is not limited to specific ones. For example, in accordance with JIS H8688: 2013 (Anodizing of aluminum and its alloys-Determination of mass per unit area (surface density) of anodic oxidation coatings), the aluminum member 10 is immersed in a solution of chromic (VI) and phosphoric acid to resolve and remove the anodic oxide coating 14.

The arithmetical mean height Sa and maximum height Sz of the surface 12*a* of the substrate 12 can be measured in accordance with ISO 25178. The mean width of roughness profile elements Rsm of the surface 12*a* of the substrate 12 can be measured in accordance with JIS B0601: 2013 (ISO 4287: 1997, Amd.1: 2009).

The arithmetical mean height Sa of the surface 14*a* of the anodic oxide coating 14 is preferably 0 to 0.45 μm. The arithmetical mean height Sa of the surface 14*a* of the anodic oxide coating 14 of 0.45 μm or less makes the surface 14*a* of the anodic oxide coating 14 reflect part of light, and this further improves the whiteness of the aluminum member 10. Note that the arithmetical mean height Sa of the surface 14*a* of the anodic oxide coating 14 can be measured in accordance with ISO 25178. The arithmetical mean height Sa of the surface 14*a* of the anodic oxide coating 14 can be adjusted by polishing the surface 14*a* or some other means.

In the present embodiment, it is preferable that the L* value in the L*a*b* color system of the aluminum member 10 measured from the anodic oxide coating 14 side is 85 to 100, that the a* value is −1 to +1, and that the b* value is −1.5 to +1.5. The L* value, a* value, and b* value in the L*a*b* color system can be determined in accordance with JIS Z8781-4: 2013 (Colorimetry-Part 4: CIE 1976 L*a*b* Colour space). Specifically, the L* value, a* value, and b* value can be measured with a chromatic color-difference meter, and they can be measured under conditions such as the diffuse illumination/0° viewing angle (D/0), viewing angle 2°, and illuminant C.

The L* value of 85 or more improves the lightness and thus further improves the whiteness of the aluminum member 10. The upper limit of the L* value is not limited to a specific one, and hence it is 100, which is the maximum value of the L* value. Note that it is more preferable that the L* value is 85.5 or more.

The a* value of from −1 to +1 and the b* value of from −1.5 to +1.5 means that the chromatic value is close to 0, and this prevents the aluminum member 10 from looking reddish, yellowish, greenish, and bluish and further improves the whiteness of the aluminum member 10. Note that it is preferable that the a* value is −0.8 to +0.8, and that the b* value is −0.8 to +0.8.

It is preferable that the arithmetical mean height Sa of the surface 14*a* of the anodic oxide coating 14 is 0 to 0.45 μm, and that the L* value is 85.5 to 100. This makes the surface 14*a* of the anodic oxide coating 14 reflect part of light and further improves the whiteness of the aluminum member 10.

As has been described above, the aluminum member according to the present embodiment includes the substrate formed of aluminum or an aluminum alloy and the anodic oxide coating formed on the surface of the substrate. The aluminum or aluminum alloy contains 0 to 10% by mass of magnesium, 0.1% by mass or less of iron, and 0.1% by mass or less of silicon, and the balance is aluminum and unavoidable impurities. Then, the surface of the substrate on the anodic oxide coating side has an arithmetical mean height Sa of 0.1 to 0.5 μm, a maximum height Sz of 0.2 to 5 μm, and an mean width of roughness profile elements Rsm of 0.5 to 10 μm, where these values are measured after the anodic oxide coating is removed. These features make the appearance of the aluminum member of the present embodiment look as white as paper.

The aluminum member of the present embodiment, having an appearance as white as paper, can be preferably used, for example, for casings of smartphones and personal computers.

[Method of Producing Aluminum Member]

Figure 2:
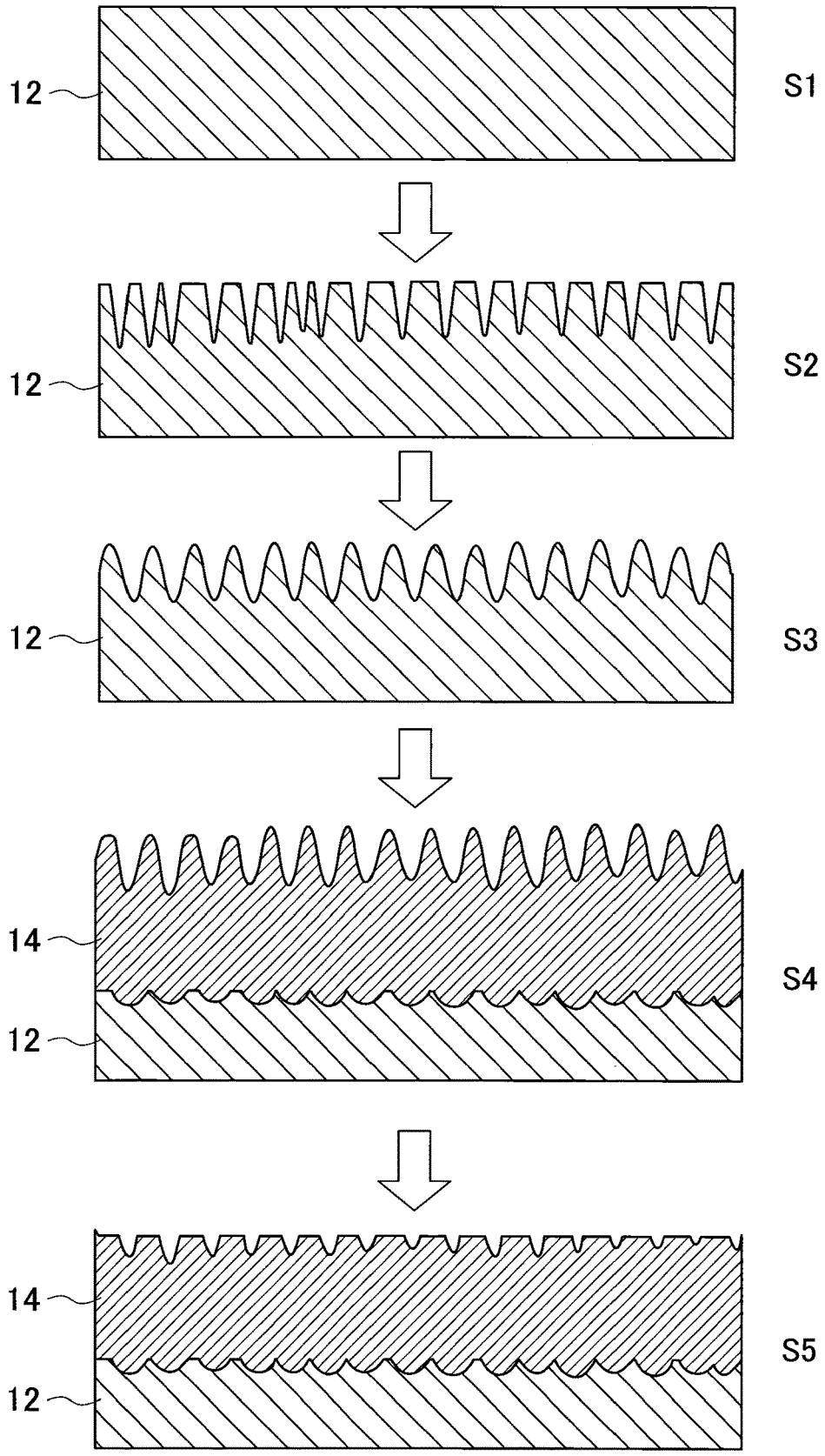
FIG. 2 is a diagram illustrating an example of a method of producing the aluminum member according to the present embodiment.

Although the method of producing the aluminum member of the present embodiment is not limited to specific ones, the method may include, as illustrated in FIG. 2, for example, a substrate preparation process S1, abrasive blasting process S2, etching process S3, anodization process S4, and polishing process S5. Hereinafter, each process will be described in detail.

(Substrate Preparation Process S1)

The substrate preparation process Si is for preparing the substrate 12. The method of preparing the substrate 12 is not limited to specific ones, and a known method can be used for it. For example, the substrate 12 can be prepared by preparing molten metal having specified elements, casting, rolling, heat treatment, and other processes. As an alternative, the substrate 12 may be used as is after casting, after rolling, or after heat treatment, without subjecting to specific surface treatment. As an alternative, the substrate 12 may be grinded with a milling machine, and the surface 12*a* may be polished using emery paper, buff polishing, electrolytic polishing, and the like. Note that before being used, the surface 12*a* of the substrate 12 may be polished to adjust the arithmetical mean height Sa to approximately 100 nm or less. The surface of the substrate 12 having an arithmetical mean height Sa of 100 nm or less increases the lightness of the substrate 12. This enables the aluminum member 10 to have a white appearance closer to paper even after the abrasive blasting process S2, etching process S3, and anodization process S4.

(Abrasive Blasting Process S2)

In the abrasive blasting process S2, abrasive blasting makes particles hit against the surface 12*a* of the substrate 12 to form irregularities on the surface 12*a*. The conditions of abrasive blasting are not limited to specific ones but may be any conditions as long as the arithmetical mean height Sa, maximum height Sz, and mean width of roughness profile elements Rsm of the surface 12*a* of the substrate 12 on the anodic oxide coating 14 side after the anodic oxide coating 14 is removed are within the respective specified ranges, as described above. Note that the method of abrasive blasting is not limited to specific ones, but, for example, at least one of wet blasting and dry blasting may be used for it.

It is preferable that the method of producing the aluminum member of the present embodiment includes a process of making particles having an average particle diameter of 20 μm or less hit against the surface 12*a* of the substrate 12. In the case where the particles to hit against the surface 12*a* of the substrate 12 have an average particle diameter of 20 μm or less, protrusions on the surface 12*a* of the substrate 12 after the anodic oxide coating is formed are fine. This prevents light that has passed through the anodic oxide coating 14 from being absorbed between irregularities on the surface 12*a* of the substrate 12 and makes the appearance of the aluminum member 10 whiter. Note that it is more preferable that the average particle diameter of particles is 10.5 μm or less. The lower limit of the average particle diameter of particles is not limited to a specific one, but it is preferable that the average particle diameter is 2 μm or more. In the case where the average particle diameter of particles is 2 μm or more, irregularities are properly formed on the surface 12*a* of the substrate 12, which diffusely reflects the light that has passed through the anodic oxide coating 14. For this reason, the aluminum member 10 looks white even if it is viewed obliquely from different viewing angles, and this makes the aluminum member 10 look as white as paper. Note that the average particle diameter of particles refers to the particle diameter at the point where the cumulative value is 50% in the particle size distribution on the volume basis, which can be measured by, for example, a laser diffraction-scattering method.

Examples of particles used for abrasive blasting include ceramic beads containing silicon carbide, boron carbide, boron nitride, alumina, zirconia, and the like; metal beads containing steel and the like; resin beads containing nylon, polyester, melamine resin, and the like; and glass beads containing glass and the like. Note that in the case of wet blasting, particles can be mixed in a liquid such as water, and it can be jetted against the substrate 12. The conditions of abrasive blasting such as the blast pressure and the total number of particles are not limited to specific ones. The conditions can be adjusted as appropriated depending on the state of the substrate 12 or other factors.

(Etching Process S3)

The etching process S3 for removing sharp edges of the irregularities on the surface 12*a* of the substrate 12 formed in the abrasive blasting process S2 to smoothen the irregularities. The conditions of etching are not limited to specific ones but may be any conditions as long as the arithmetical mean height Sa, maximum height Sz, and mean width of roughness profile elements Rsm of the surface 12*a* of the substrate 12 on the anodic oxide coating 14 side after the anodic oxide coating 14 is removed are within the respective specified ranges, as described above.

It is preferable that the method of producing the aluminum member of the present embodiment has a step of etching the substrate 12 that particles have hit using at least one of an acidic solution and an alkaline solution. For the acidic solution, for example, an aqueous solution of hydrochloric acid, sulfuric acid, nitric acid, or the like can be used. For the alkaline solution, for example, an aqueous solution of sodium hydroxide, potassium hydroxide, sodium carbonate, or the like can be used. The concentrations of the acidic solution and the alkaline solution are not limited to specific ones, but as an example, in the case of using an aqueous solution of sodium hydroxide, the concentration of an aqueous solution of sodium hydroxide may be 1 to 10%.

The etching time and the etching temperature are also not limited to specific values and may be adjusted as necessary depending on the state of the substrate 12 and the etchant. As examples, the etching time is 5 to 90 seconds, and the etching temperature is 40 to 60° C.

(Anodization Process S4)

The method of producing the aluminum member of the present embodiment may include a step of forming the anodic oxide coating 14 by anodizing the surface 12*a* of the substrate 12. The method of anodization is not limited to specific ones, but the surface 12*a* of the substrate 12 can be oxidized, for example, by electrolyzing an aqueous electrolyte solution with the substrate 12 set on an anode. Note that in the case where the substrate 12 is etched as described above, it is preferable that the method of producing the aluminum member of the present embodiment includes a step of forming the anodic oxide coating 14 by anodizing the etched surface 12*a* of the substrate 12.

The electrolytic treatment liquid used for the anodization is not limited to specific kinds, but a known electrolytic treatment liquid can be used. It is preferable that the electrolytic treatment liquid is a polybasic acid aqueous solution because aluminum has a low degree of solubility in it. The polybasic acid is not limited to any specific kinds, but examples of polybasic acids include sulfuric acid, phosphoric acid, chromic acid, oxalic acid, tartaric acid, and malonic acid. Note that it is preferable that the electrolytic treatment liquid is at least one aqueous solution selected from the group consisting of sulfuric acid, phosphoric acid, and oxalic acid. In other words, it is preferable that the method of producing the aluminum member of the present embodiment has a step of forming the anodic oxide coating 14 by anodizing the surface 12*a* of the substrate 12 using at least one aqueous solution selected from the group consisting of sulfuric acid, phosphoric acid, and oxalic acid.

The conditions of the electrolysis for anodization are not limited to specific ones and may be adjusted as necessary depending on the state of the substrate 12 and other factors. As an example, the temperature of the electrolytic treatment liquid is 10 to 30° C., the voltage is 10 to 20 V, the electrical quantity is 10 to 30 $C/cm^2$, and the electrolysis time is 20 to 50 minutes.

(Polishing Process S5)

The polishing process S5 is for polishing and smoothing the surface 14*a* of the anodic oxide coating 14. The smoothed surface 14*a* of the anodic oxide coating 14 reduces diffused reflection of light at the surface 14*a* of the anodic oxide coating 14 and improves the light reflectance of the surface 14*a* of the anodic oxide coating 14. Thus, the polishing process S5 further improves the L* value of the aluminum member 10.

The method of polishing is not limited to specific ones as long as it is capable of smoothing the surface 14*a* of the anodic oxide coating 14, but examples include physical polishing such as blast polishing and buff polishing. Specifically, it is preferable that the method of producing the aluminum member of the present embodiment has a step of polishing the surface 14*a* of the anodic oxide coating 14 by at least one of blast polishing and buff polishing. The blast polishing may be either wet blast polishing or dry blast polishing. As a blast polishing method, SIRIUS Processing (registered trademark) available from Fuji Manufacturing Co., Ltd. may be used to polish the surface 12*a* of the substrate 12.

Note that although this is not intended to limit the present embodiment, the method of producing the aluminum member of the present embodiment may further include a sealing step for sealing the micropores in the coating cells to improve the corrosion resistance. The sealing process may be performed by a known method. The process can be performed, for example, using hot water vapor, nickel acetate aqueous solution, and nickel fluoride, or the like.

It is preferable that the method of producing the aluminum member has a step of making particles having an average particle diameter of 20 μm or less hit against the surface 12*a* of the substrate 12, and a step of etching the substrate 12 that particles have hit using at least one of an acidic solution and an alkaline solution. Then, it is preferable that the method of producing the aluminum member has a step of forming the anodic oxide coating 14 by anodizing the etched surface 12*a* of the substrate 12. Through these steps included as above, the arithmetical mean height Sa, maximum height Sz and mean width of roughness profile elements Rsm of the surface 12*a* of the substrate 12 on the anodic oxide coating 14 side after the anodic oxide coating 14 is removed become within specified ranges. Thus, the method of producing the aluminum member of the present embodiment provides the aluminum member 10 having an appearance as white as paper.

EXAMPLES

Although hereinafter, the present embodiment will be described in more detail using examples and comparative examples, the present embodiment is not limited to these examples.

Example 1

A substrate was prepared by cutting a test piece with dimensions of 50 mm×50 mm out of an aluminum alloy plate subjected to a rolling process and having a thickness of 3 mm Note that the substrate contains 4% by mass of magnesium (Mg), 0.02% by mass of iron (Fe), and 0.02% by mass of silicon, and the balance is aluminum (Al) and unavoidable impurities.

Next, dry blasting was performed by making particles hit against the substrate to form irregularities on the surface of the substrate. The particles used were Fuji Random WA particle number 800 (maximum particle diameter: 38.0 μm, average particle diameter: 14.0±1.0 μm) available from Fuji Manufacturing Co., Ltd.

Then, an aqueous solution of 5% sodium hydroxide prepared by dissolving 50 g sodium hydroxide per 1 L water was heated to 50° C., and the substrate on which the irregularities had been formed was immersed in this aqueous solution for 90 seconds to etch the substrate.

The etched substrate was immersed in an aqueous solution of 15% sulfuric acid to anodize the substrate under the conditions of the temperature of the aqueous solution of sulfuric acid 18° C., the voltage 15 V, the electrical quantity 20 C/cm$^2$, and the process time 35 minutes. With this process, the anodic oxide coating is formed on the surface of the substrate, and an aluminum member is obtained.

Example 2

Instead of particles of particle number 800, particle used were Fuji Random WA particle number 1000 (maximum particle diameter: 32.0 μm, average particle diameter: 11.5±1.0 μm) available from Fuji Manufacturing Co., Ltd., and the etching time was set to 30 seconds. An aluminum member was prepared in the same way as for example 1 except the above conditions.

Example 3

Instead of particles of particle number 800, particle used were Fuji Random WA particle number 2000 (maximum particle diameter: 19.0 μm, average particle diameter: 6.7±0.6 μm) available from Fuji Manufacturing Co., Ltd., and the etching time was set to 30 seconds. An aluminum member was prepared in the same way as for example 1 except the above conditions.

Example 4

Instead of particles of particle number 800, particle used were Fuji Random WA particle number 4000 (maximum particle diameter: 11.0 μm, average particle diameter: 3.0±0.4 μm) available from Fuji Manufacturing Co., Ltd., and the etching time was set to 5 seconds. An aluminum member was prepared in the same way as for example 1 except the above conditions.

Example 5

Instead of dry blasting, wet blasting is used to form irregularities on the surface of the substrate. In addition, instead of particles of particle number 800, particle used were Fuji Random WA particle number 1200 (maximum particle diameter: 27.0 μm, average particle diameter: 9.5±0.8 μm) available from Fuji Manufacturing Co., Ltd. The etching time was set to 30 seconds. An aluminum member was prepared in the same way as for example 1 except the above conditions.

Example 6

Wet blasting was used to polish the surface of the anodic oxide coating. An aluminum member was prepared in the same way as for example 5 except the above condition.

Example 7

SIRIUS Processing was used to polish the surface of the anodic oxide coating. An aluminum member was prepared in the same way as for example 5 except the above condition.

Example 8

Buff polishing was used to polish the surface of the anodic oxide coating. An aluminum member was prepared in the same way as for example 5 except the above condition.

Comparative Example 1

Instead of particles of particle number 800, particle used were Fuji Random WA particle number 400 (maximum particle diameter: 75.0 μm, average particle diameter: 30.0±2.0 μm) available from Fuji Manufacturing Co., Ltd., and the etching time was set to 30 seconds. An aluminum member was prepared in the same way as for example 1 except the above conditions.

Comparative Example 2

Instead of dry blasting, wet blasting is used to form irregularities on the surface of the substrate. In addition, instead of particles of particle number 800, particle used were Fuji Random WA particle number 8000 (maximum particle diameter: 6.0 μm, average particle diameter: 1.2±0.3 μm) available from Fuji Manufacturing Co., Ltd. The etching time was set to 60 seconds. An aluminum member was prepared in the same way as for example 1 except the above conditions.

Comparative Example 3

A substrate was used that contained 4% by mass of magnesium (Mg), 0.1% by mass of iron (Fe), and 0.3% by mass of silicon (Si), and the balance of which was aluminum (Al) and unavoidable impurities. An aluminum member was prepared in the same way as for example 5 except the above condition.

[Evaluation]

The aluminum member obtained in each example was evaluated as follows in terms of the arithmetical mean height Sa, the maximum height Sz, the mean width of roughness profile elements Rsm, the color tone, and the appearance. Details and evaluation results of each example are shown in Table 1 and Table 2.

(Arithmetical Mean Height Sa and Maximum Height Sz)

First, each aluminum member obtained as described above was immersed in a solution of phosphoric acid and chromic (VI) and phosphoric acid in accordance with JIS H8688: 2013 to dissolve and remove the anodic oxide coating. Then, the arithmetical mean height Sa and the maximum height Sz of the surface on the anodic oxide coating side of the substrate were measured in accordance with ISO 25178. Note that the measurement conditions for the arithmetical mean height Sa and the maximum height Sz are as follows.

Measurement Conditions for Arithmetical mean height Sa and Maximum height Sz

Instrument: Bruker AXS GmbH, 3D white-light interference microscope Contour GT-I Measured area: 60 μm×79 μm Objective lens: 115×

Internal lens: 1×

(Mean Width of Roughness Profile Element Rsm)

First, the anodic oxide coating of each aluminum member obtained as described above were dissolved and removed in a solution of phosphoric acid and chromic (VI) and phosphoric acid in accordance with JIS H8688: 2013. Then, the mean width of roughness profile elements Rsm of the surface on the anodic oxide coating side of the substrate was measured in accordance with JIS B0601: 2013. Note that the measurement conditions for the mean width of roughness profile elements Rsm are as follows.

Measurement Conditions for Mean Width of Roughness Profile Element Rsm

Instrument: Bruker AXS GmbH, 3D white-light interference microscope Contour GT-I Cut off λc: 80 μm Objective lens: 115×

Internal lens: 1×

Measurement distance: 79 μm (Color Tone)

The color tone of each aluminum member was measured from the surface of the anodic oxide coating using a chromatic color-difference meter in accordance with JIS Z8722 to determine the L* value, a* value, and b* value. Note that the conditions for the color measurement are as follows.

Measurement Conditions for Color Tone

Chromatic color-difference meter: CR400 available from KONICA MINOLTA JAPAN, INC.

Illumination/viewing optical system: diffuse illumination/0° viewing angle (D/0)

Observation condition: viewing angle 2 degrees closely matching CIE color-matching functions Illuminant: illuminant C Color system: L*a*b*

(Appearance)

The color tone of each aluminum member was visually evaluated for the case where the surface of the anodic oxide coating is viewed perpendicularly and where the surface of the anodic oxide coating is viewed obliquely.

TABLE 1

| | Substrate | | | Before anodization | | | | |
|---|---|---|---|---|---|---|---|---|
| | | | | Abrasive blasting | | | | |
| | Composition (% by mass) (the balance: aluminum and unavoidable impurities) | | | | | Average particle diameter | Etching Time | After anodization Polishing |
| | Mg | Fe | Si | Method | Particles | (μm) | (second) | Method |
| Example 1 | 4 | 0.02 | 0.02 | dry blasting | WA#800 | 14.0 | 90 | — |
| Example 2 | 4 | 0.02 | 0.02 | dry blasting | WA#1000 | 11.5 | 30 | — |
| Example 3 | 4 | 0.02 | 0.02 | dry blasting | WA#2000 | 6.7 | 30 | — |
| Example 4 | 4 | 0.02 | 0.02 | dry | WA#4000 | 3.0 | 5 | — |

TABLE 1-continued

| | Substrate | | | Before anodization | | | | |
|---|---|---|---|---|---|---|---|---|
| | | | | Abrasive blasting | | | | |
| | Composition (% by mass) (the balance: aluminum and unavoidable impurities) | | | | | Average particle diameter | Etching Time | After anodization Polishing |
| | Mg | Fe | Si | Method | Particles | (μm) | (second) | Method |
| Example 5 | 4 | 0.02 | 0.02 | blasting wet blasting | WA#1200 | 9.5 | 30 | — |
| Example 6 | 4 | 0.02 | 0.02 | wet blasting | WA#1200 | 9.5 | 30 | wet blasting polishing |
| Example 7 | 4 | 0.02 | 0.02 | wet blasting | WA#1200 | 9.5 | 30 | SIRIUS Processing |
| Example 8 | 4 | 0.02 | 0.02 | wet blasting | WA#1200 | 9.5 | 30 | buff polishing |
| Comparative Example 1 | 4 | 0.02 | 0.02 | dry blasting | WA#400 | 30.0 | 30 | — |
| Comparative Example 2 | 4 | 0.02 | 0.02 | wet blasting | WA#8000 | 1.2 | 60 | — |
| Comparative Example 3 | 4 | 0.1 | 0.3 | wet blasting | WA#1200 | 9.5 | 30 | — |

TABLE 2

| | Surface shape of substrate | | | Color tone | | | | |
|---|---|---|---|---|---|---|---|---|
| | | | | Color measurement | | | Visual check | |
| | Sa (μm) | Sz (μm) | Rsm (μm) | L* | a* | b* | Perpendicular direction | Oblique direction |
| Example 1 | 0.38 | 4.49 | 9.05 | 88.11 | −0.68 | −0.04 | white | white |
| Example 2 | 0.30 | 3.43 | 8.75 | 86.92 | −0.72 | −0.11 | white | white |
| Example 3 | 0.19 | 1.88 | 7.85 | 90.24 | −0.22 | 0.24 | white | white |
| Example 4 | 0.13 | 1.69 | 6.67 | 88.89 | −0.37 | 0.73 | white | white |
| Example 5 | 0.20 | 1.94 | 7.40 | 88.50 | −0.23 | 0.76 | white | white |
| Example 6 | 0.20 | 1.94 | 7.40 | 90.72 | −0.19 | 0.76 | white | white |
| Example 7 | 0.20 | 1.94 | 7.40 | 90.93 | −0.16 | 0.60 | white | white |
| Example 8 | 0.20 | 1.94 | 7.40 | 90.90 | −0.21 | 0.70 | white | white |
| Comparative Example 1 | 0.76 | 8.61 | 21.15 | 79.19 | −0.56 | −0.3 | gray | white |
| Comparative Example 2 | 0.03 | 0.30 | 8.10 | 92.00 | −0.33 | 0.13 | white | gray |
| Comparative Example 3 | 0.19 | 2.00 | 7.50 | 85.75 | −0.51 | 2.05 | yellowish white | yellowish white |

As Tables 1 and 2 show, for the aluminum members of examples 1 to 8, the L* value is within the range of 85 to 100; the a* value is within the range of −1 to +1; and the b* value is within the range of −1.5 to +1.5. In addition, the aluminum members of examples 1 to 8 are white when viewed from both the perpendicular direction and the oblique direction.

On the other hand, for the aluminum member of comparative example 1, since particles with large particle diameters were used for abrasive blasting, the surface of the substrate became coarse, and the appearance is gray. For the aluminum member of comparative example 2, since particles with small particle diameters were used for abrasive blasting, the surface of the substrate became smooth, and the appearance is white when viewed from the perpendicular direction. However, when viewed from the oblique direction, the appearance is gray. For the aluminum member of comparative example 3, since the amount of silicon contained in the substrate is large, the amount of silicon in the anodic oxide coating became too large, making the appearance yellowish white.

The entire contents of Japanese Patent Application No. 2017-164174 (filed on Aug. 29, 2017) are incorporated herein.

Although the present embodiment has been described using examples and comparative examples as above, the present embodiment is not limited to these examples but can be modified variously within the scope of the present embodiment.

INDUSTRIAL APPLICABILITY

The present invention provides an aluminum member having an appearance as white as paper and a method for producing the same.

REFERENCE SIGNS LIST

10 aluminum member
12 substrate
12*a* surface
14 anodic oxide coating
14*a* surface

The invention claimed is:

1. A method of producing an aluminum member comprising a substrate and an anodic oxide coating comprising making particles having an average particle diameter of 20 μm or less hit against a surface of the substrate by dry blasting;

etching the substrate against which the particles have hit, using at least one of an acidic solution and an alkaline solution; and forming the anodic oxide coating by anodizing an etched surface of the substrate, wherein the substrate is formed of aluminum or an aluminum alloy that contains 0 to 10% by mass of magnesium, 0.1% by mass or less of iron, and 0.1% by mass or less of silicon and a balance of which is aluminum and unavoidable impurities, wherein the anodic oxide coating is formed on the surface of the substrate, and wherein the surface of the substrate on the anodic oxide coating side has an arithmetical mean height Sa of 0.1 to 0.5 μm, a maximum height Sz of 0.2 to 5 μm, and an mean width of roughness profile elements Rsm of 0.5 to 10 μm, where the arithmetical mean height Sa, the maximum height Sz, and the mean width of roughness profile elements Rsm are measured in a case where the anodic oxide coating is removed.

2. The method of producing the aluminum member according to claim 1, wherein the substrate consists of 0 to 10% by mass of magnesium, 0.1% by mass or less of iron, and 0.1% by mass or less of silicon and the balance of which is aluminum and 0.5% by mass or less of unavoidable impurities, and a content of each element contained as the unavoidable impurities is 0.05% by mass or less.

3. The method of producing the aluminum member according to claim 1, wherein the substrate consists of 0 to 10% by mass of magnesium, 0.1% by mass or less of iron, and 0.1% by mass or less of silicon and the balance of which is aluminum and 0.15% by mass or less of unavoidable impurities, and a content of each element contained as the unavoidable impurities is 0.05% by mass or less.

4. The method of producing the aluminum member according to claim 1, wherein the anodic oxide coating is formed by using at least one aqueous solution selected from the group consisting of sulfuric acid, phosphoric acid, and oxalic acid.

5. The method of producing the aluminum member according to claim 1, wherein a time of the etching is 5 to 90 seconds.

6. The method of producing the aluminum member according to claim 1, wherein the aluminum member has an L* value of 85 to 100, an a* value of −1 to +1, and a b* value of −1.5 to +1.5, where the L* value, the a* value, and the b* value are values in a L*a*b* color system measured from the anodic oxide coating side.

7. The method of producing the aluminum member according to claim 1, wherein a surface of the anodic oxide coating has an arithmetical mean height Sa of 0 to 0.45 μm, and the L* value is 85.5 to 100.

8. The method of producing the aluminum member according to claim 1, further comprising polishing a surface of the anodic oxide coating by at least one of blast polishing and buff polishing.

* * * * *